US007316313B1

(12) United States Patent
Juchau

(10) Patent No.: US 7,316,313 B1
(45) Date of Patent: Jan. 8, 2008

(54) HEATED EQUIPMENT BAG

(76) Inventor: Jason R. Juchau, 1902 Sprucehill Road, Pickering, ON (CA) L1V 1S7

( * ) Notice: Subject to any disclaimer, the term of this patent is extended or adjusted under 35 U.S.C. 154(b) by 390 days.

(21) Appl. No.: 10/966,928

(22) Filed: Oct. 15, 2004

(51) Int. Cl.
*B65D 85/20* (2006.01)

(52) U.S. Cl. ..... 206/315.1; 190/109

(58) Field of Classification Search ..... 206/315.1, 206/314, 524.1, 524.2, 524.3; 190/124, 125, 190/109, 110; 219/386, 387, 214
See application file for complete search history.

(56) References Cited

U.S. PATENT DOCUMENTS

| | | | | |
|---|---|---|---|---|
| 2,504,132 | A * | 4/1950 | Jones | 219/387 |
| 3,051,582 | A * | 8/1962 | Muckler et al. | 426/418 |
| 3,091,681 | A | 5/1963 | Mayer | |
| 4,155,002 | A | 5/1979 | Cohen | |
| 4,578,874 | A * | 4/1986 | Juengel | 33/561 |
| 4,806,736 | A * | 2/1989 | Schirico | 219/386 |
| 4,816,646 | A * | 3/1989 | Solomon et al. | 219/387 |
| 5,183,994 | A * | 2/1993 | Bowles et al. | 219/387 |
| D357,351 | S | 4/1995 | Kelsall | |
| 5,416,886 | A | 5/1995 | Zahler | |
| 5,660,751 | A * | 8/1997 | O'Rorke et al. | 219/411 |
| 6,018,143 | A * | 1/2000 | Check | 219/387 |
| 6,222,160 | B1 * | 4/2001 | Remke et al. | 219/387 |
| 6,247,469 | B1 | 6/2001 | Guard | |
| 6,248,981 | B1 * | 6/2001 | Check | 219/387 |
| 6,263,591 | B1 | 7/2001 | La Porte | |
| 6,281,477 | B1 * | 8/2001 | Forrester et al. | 219/387 |
| 7,122,763 | B1 * | 10/2006 | Liu et al. | 219/214 |
| 2003/0192789 | A1 | 10/2003 | Severa | |

* cited by examiner

*Primary Examiner*—Shian T. Luong
(74) *Attorney, Agent, or Firm*—Lawrence J. Gibney, Jr.

(57) ABSTRACT

This is a sports equipment bag that can be heated to provide comfort for the user of various equipment, particularly those sports involved in extremely cold temperatures, such as hockey.

1 Claim, 4 Drawing Sheets

HEATED EQUIPMENT BAG

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This relates to a device to heat sporting equipment. Although hockey equipment will be reference in this application this particular device is not limited simply to hockey equipment but to any equipment that is used in cold weather environments.

B. Prior Art

Representative examples include Suvera, publication number US2003/0192789, Cohen, 4,155,002, and Laporte 6,263,591 and Guard 6,247,469.

The Guard device is simply a warmer for a sporting element as is Suvera.

One of the objects of this invention is to be able to carry the necessary equipment, plug it into a cigarette lighter or other source of power and have heated hockey or sports equipment.

None of the prior art achieves those particular results.

BRIEF SUMMARY OF THE INVENTION

Cold weather sports have been around for many years. Hockey is one of those cold weather sports and is very popular in the northern United States as well as Canada and many other countries.

In an effort to ensure that the equipment for the players is kept warm, this device has been contemplated. It uses a thermally insulated bag with a heating wire to store all necessary equipment, with the exception of the hockey stick, inside the bag. The heating wire or coil will be powered by plugging the device into a cigarette lighter or an alternate power source such as an AC outlet.

In one embodiment there may be communication between the compartments as well as a fan to move the heated air through the bag.

A carrying handle will be provided as well as a means to access all cavities or compartments of the bag.

DETAILED DESCRIPTION OF THE EMBODIMENT

Figure 1:
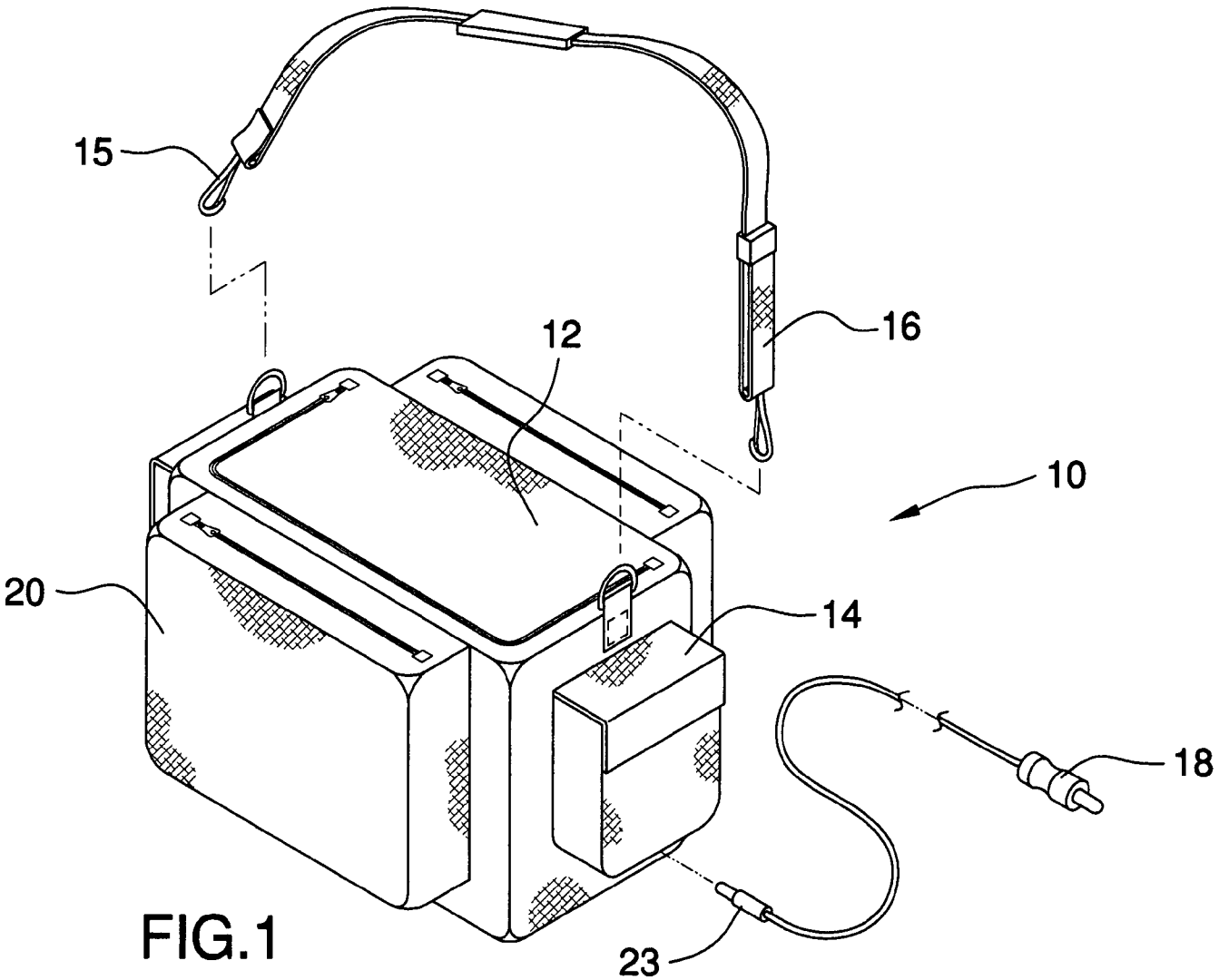
FIG. 1 is a perspective view of the device.
Figure 2:
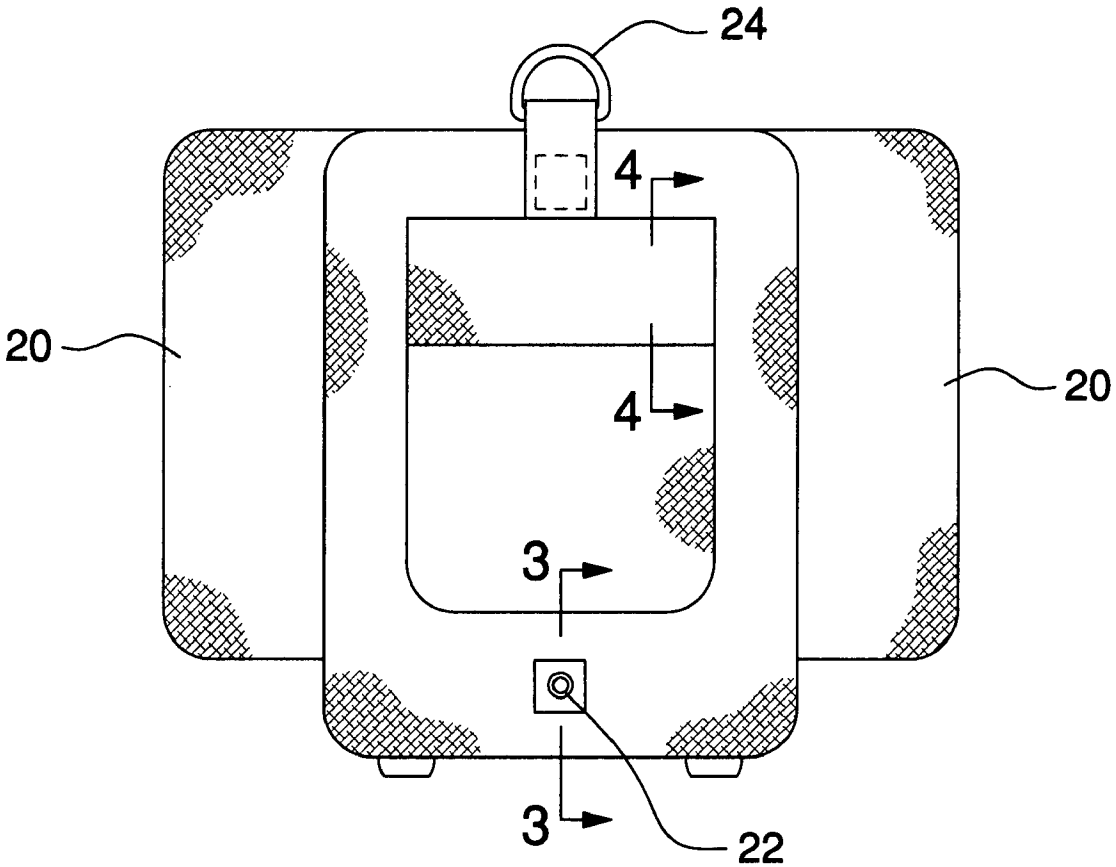
FIG. 2 is a side view of the device.

The heated sports equipment bag 10 is a bag that comes equipped with an adjustable carrying strap 16, which attaches by means of snap hooks 15 on the top surface of this bag. Loops 24 are provided to attach the snap hooks 15 and carry the bag 10. FIGS. 1, 2

The bag 10 itself contains a main chamber 12, as well as storage areas 20 on both sides of the main chamber 12. It is contemplated that the entire bag will be constructed in a single piece with a plurality of storage compartments. On one side of the device is another smaller storage area 14 for socks and other smaller items. FIG. 1

Figure 4:
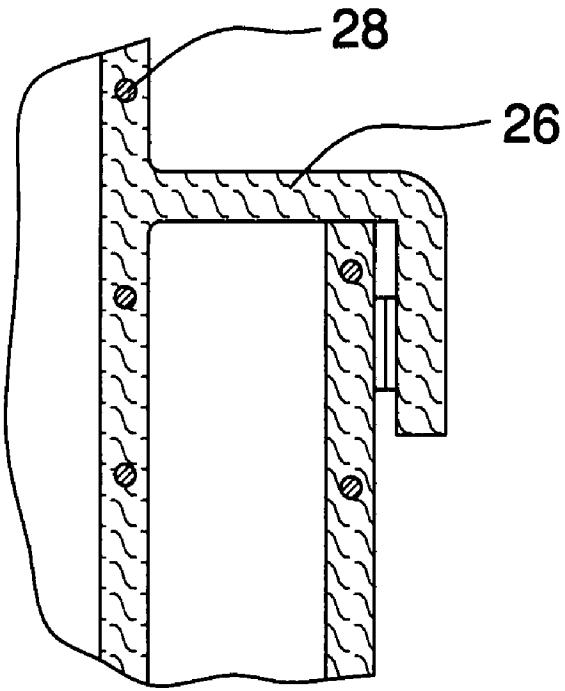
FIG. 4 is a cross sectional view according to line 4-4 on FIG. 2.
Figure 3:
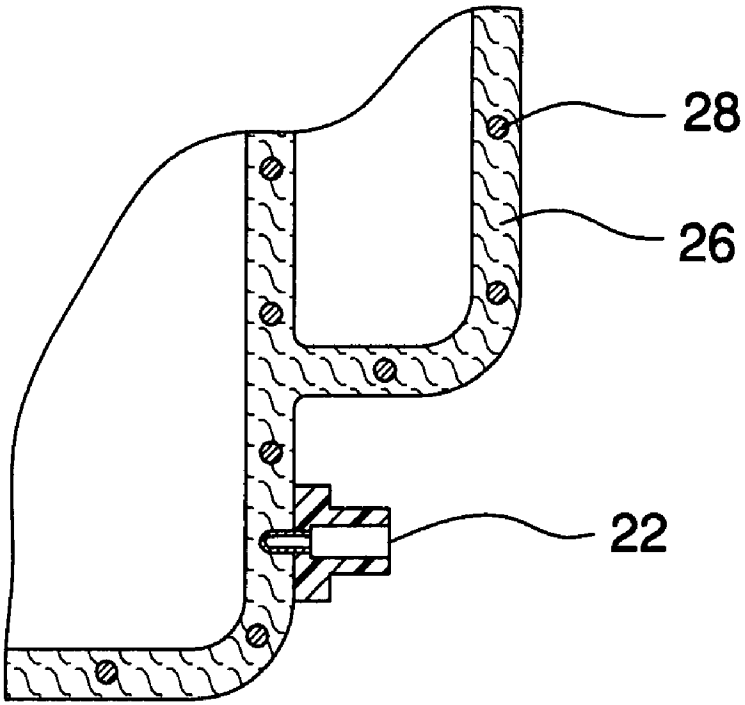
FIG. 3 is a cross sectional view according to line 3-3 on FIG. 2.

The device 10 is equipped with a means to heat the interior of the bag 10 by use of a heating coil or wire 28 throughout the interior of the bag, and appropriate insulating material 26 to keep the bag and items warm. FIGS. 3,4 The power source for this particular device is contemplated to be a cigarette lighter plug in 18 with appropriate male 23 and female 22 ends. FIGS. 1,2 The female end 22 is located on the side of the bag 10 and will provide communication with a method to heat the wire 28 and therefore keep the contents of the bag 10 warm. The heating wire 28 and insulating material 26 itself will be located within the interior walls of the bag 10. FIGS. 3, 4

It is anticipated that the female end of the heating element 22 will be on the side of the bag under the storage area for the socks 14. FIG. 2 This particular placement is to prevent damage to the female 22 end.

The user of the hockey equipment can also monitor the temperature, but it is anticipated that the temperature of the equipment will stay warm while not getting hot.

SECOND EMBODIMENT

Figure 6:
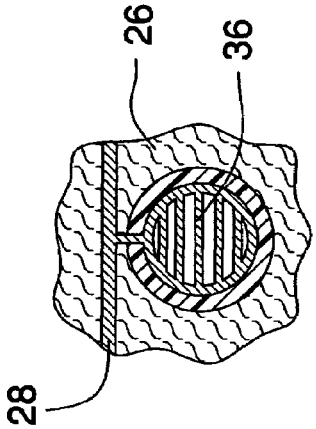
FIG. 6 is a cross sectional view according to line 6-6 on FIG. 5.
Figure 5:
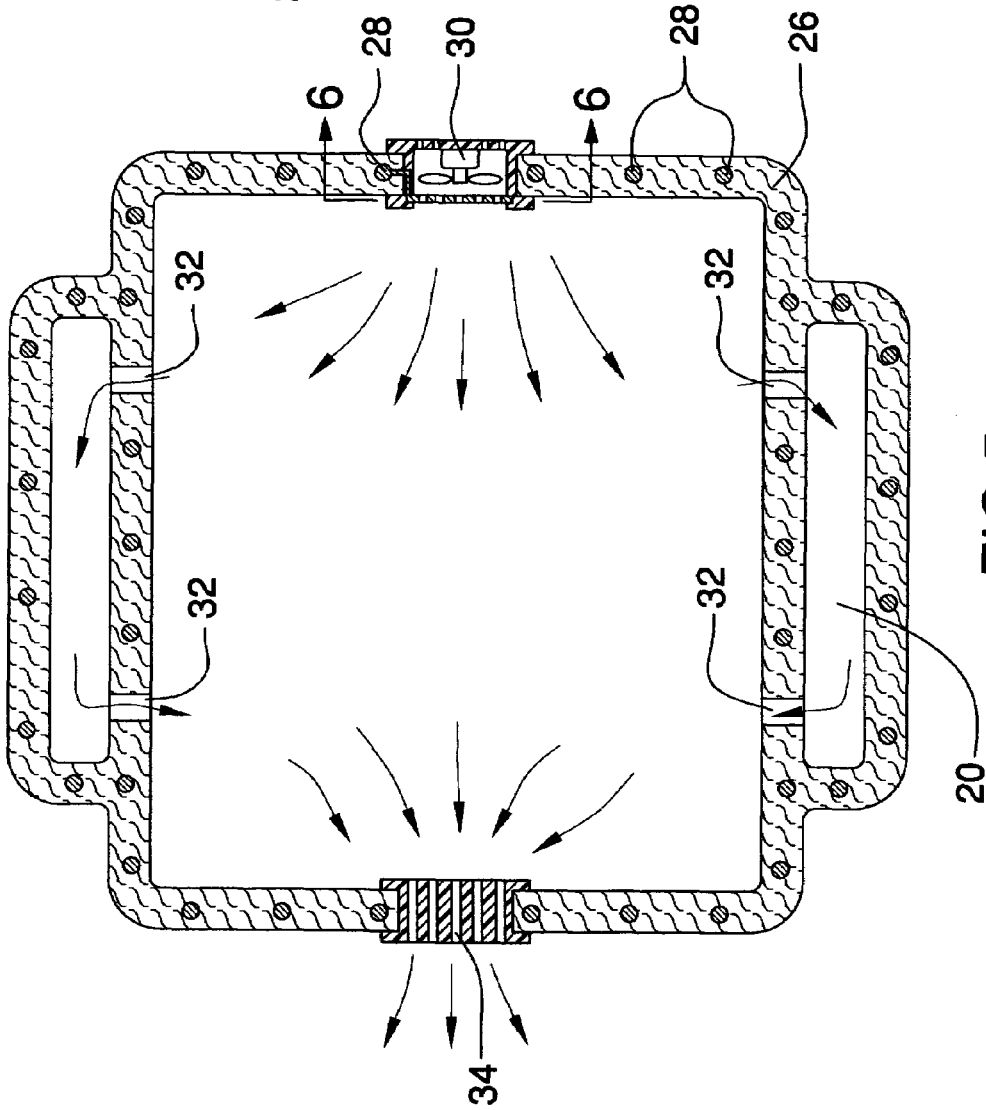
FIG. 5 is a top cross sectional view.

FIGS. 5 and 6 depict a second embodiment of this particular device. The common elements are the heating wire 28 and insulating material 26 as well as the general configuration of the bag 10 itself including the means to provide power to the heating wire or coil 28. According to FIG. 5 the interior of the bag is equipped with portholes 32 that provide a means to distribute the air throughout the interior of the bag 10. FIG. 5

This configuration allows for the free and unimpeded transfer of warm air between the interior of the bag 10 and through both side pockets 20. An exhaust port 34 is located on the outside of the bag to exhaust warm air and therefore have a free flow of air throughout the interior of the bag. FIG. 5 A fan 30 is located on the opposite side of the exhaust port 34 as a means to circulate the air throughout the interior of the device.

This device will again be powered by either plugging into the cigarette lighter or by accessing an AC electrical outlet. FIG. 6 depicts a cross section of the heating element 28 as well as the insulation material 26 and guard 36 over the access for the fan. This guard 36 will prevent the equipment from contacting the fan blades and possibly destroying the fan 30 or destroying the stowed equipment.

Because of the extremely cold environment that is contemplated, various materials may be used, although the materials must be durable and withstand extremes in temperature.

While the embodiments of the invention have been disclosed, certain modifications may be made by those skilled in the art to modify the invention without departing from the spirit of the invention.

The inventor claims:

1. A sports equipment bag, which is comprised of:

a. main bag compartment;

wherein the main bag has an outside surface and an inside surface;

wherein a plurality of storage areas are provided within the main bag compartment;

b. storage areas;

c. means to transport the bag;

d. means to heat the interior of the bag;

wherein a heating wire is provided to heat the interior of the bag;

e. a fan; and f. exhaust port;

wherein a plurality of storage areas is provided to store sports equipment;

wherein the main bag compartment and storage areas are one integral piece;

wherein the heating wire is placed in the interior cavity of the bag;

wherein a carrying strap is provided as well as a means to attach the carrying strap to transport the bag;

wherein a means to provide power to the fan is provided;

said fan circulates air within the interior cavity of the device;

wherein a means to allow the flow of air from the main compartment to the side storage compartments is provided;

wherein the exhaust port allows the air to circulate within the bag and to exit the bag.

* * * * *